United States Patent [19]

Wakana et al.

[11] 4,050,605

[45] Sept. 27, 1977

[54] PANEL ASSEMBLED TANK

[75] Inventors: Hiroshi Wakana, Fuchu; Isamu Harada; Tsutomu Honma, both of Kodaira, all of Japan

[73] Assignee: Bridgestone Tire Company Limited, Tokyo, Japan

[21] Appl. No.: 690,819

[22] Filed: May 27, 1976

[30] Foreign Application Priority Data

May 30, 1975 Japan ..... 50-71992[U]

[51] Int. Cl.[2] ..... B65D 7/24; B65D 7/46

[52] U.S. Cl. ..... 220/5 A; 220/72; 220/80; 220/83

[58] Field of Search ..... 220/5 A, 20, 71, 72, 220/83; 52/80, 273, 284, 578, 582, 622, 624, 625, 629

[56] References Cited

U.S. PATENT DOCUMENTS

| | | | |
|---|---|---|---|
| 1,515,996 | 11/1924 | Buchanan | 220/5 A |
| 1,981,568 | 11/1934 | Owen | 220/5 A |
| 2,625,290 | 1/1953 | Kice et al. | 220/72 X |
| 2,806,622 | 9/1957 | Leirer | 220/5 A |
| 2,953,276 | 9/1960 | Dunn | 220/5 A |
| 3,064,770 | 11/1962 | Andrews | 220/5 A X |
| 3,143,194 | 8/1964 | Hart | 52/625 X |
| 3,374,916 | 3/1968 | Herff | 220/5 A |
| 3,395,824 | 8/1968 | Gerhard | 220/5 A |
| 3,460,704 | 8/1969 | Moore et al. | 220/5 A |
| 3,941,247 | 3/1976 | Cripe | 220/72 X |

FOREIGN PATENT DOCUMENTS

| | | | |
|---|---|---|---|
| 241,305 | 10/1925 | United Kingdom | 220/5 A |
| 199,590 | 6/1923 | United Kingdom | 220/5 A |

*Primary Examiner*—Stephen Marcus

*Attorney, Agent, or Firm*—Sughrue, Rothwell, Mion, Zinn & Macpeak

[57] ABSTRACT

A high pressure resistant and water tight panel assembled tank consisting of unit panels, each unit panel is formed with a protrusion portion in the form of a pyramid or truncated pyramid progressively increasing its height toward a center of the square wall surface of the panel and has securing flanges at the peripheries of the panel. The unit panels consist of (a) bottom wall panels of which securing flanges are folded in a direction opposite to the extending direction of the protrusion portion and (b) side wall panels of which securing flanges are folded in a direction the same as that of the protrusion portion and having partially thicker portions, and the securing flanges of the wall panels embracing sealing seats therebetween are clamped together outside of the tank to form the assembled tank. Assembled tie rods and panels for mounting supply and drain pipings are incorporated in the tank to improve the pressure resistance of the tank and to facilitate assembling, settling, piping and cleaning of the tank.

10 Claims, 17 Drawing Figures

PANEL ASSEMBLED TANK

BACKGROUND OF THE INVENTION

1. Field of the Invention

This invention relates to a panel assembled tank and more particularly to a panel assembled tank consisting of high pressure resistant square panels made of reinforced plastic and having high watertight and high pressure resistance.

2. Description of the Prior Art

There have been used a great number of tanks of various kinds, shapes and constructions settled at high levels as on roofs of high buildings. In this case, panel assembled tanks manufactured by a number of unit panels having peripheral edges of square wall surfaces folded to form securing flanges for connecting together the unit panels and require only unit panels necessary to assemble the tanks no matter how large the volume of the tank may be. Such unit panels are particularly preferable for manufacturing tanks to be set at high positions because the kinds of unit panels can be limited to a small number which is suitable for mass-production.

Reinforced plastics have been preferably used for the material of the unit panels. With large assembled tanks, however, there are many problems to be solved as to pressure resistance and watertightness. For example, the inner pressure of water filling the tank causes the panels and their walls to bulge outwardly. In order to mitigate the bulge in the panels, it has been suggested to form the panel with a protrusion in the form of a pyramid or truncated pyramid as explained later in connection with the drawings.

In the event that the thus formed panel having a uniform thickness and is fixed at its periphery is subjected to an inner pressure, stresses will concentrate at corners of the panel or at the bottoms of the securing flanges to cause partial failure or breakdown thereat.

With a large assembled tank, the bulging of the side walls as a whole caused by the inner pressure can not be avoided and the increased weight of the ceiling wall requires a reinforcement to support the weight which reinforcement may generally be columns. Furthermore, such columns must be worked at their ends so as to meet the shape of the bottom wall and require mounting members for setting the columns onto the bottom wall of the tank.

It is desired to reinforce the opposite side walls of the tank by means of tie rods connecting the side walls in order to restrain the bulging of the side walls as a whole to a minimum. In fact, however, it is no easy matter to assemble the panels to form a tank by rigidly clamping the tire rods to the side wall panels and to provide complete watertightness at the connections of the tie rods to the panels when the tank is filled with water in a manner that the tie rods are effectively subjected to tensile forces without undue forces acting upon the unit panels.

The bottom wall panels of the assembled tank are generally intended to resist the inner pressure by supporting tensile stresses. In other words, the panels commonly have protrusion portions extending out of the tank. Consequently, there is a tendency for connections between the panels to open away from each other resulting in less watertightness. With such panels, the cleaning of the inside of the tank is apt to be insufficient because there are recesses forming pools of water in the tank at the back of the outwardly extending protrusions of the panels.

These assembled tanks require piping for pumping and supplying water. The configuration of the panels having the pyramidal protrusions makes it difficult to provide the piping and requires particular attachments for connecting pipes to the oblique surfaces of the protrusions which may increase the cost of the tank even if they improve the accuracy of connecting the pipes. A square panel formed by a truncated pyramid having a flat center surface area can avoid the need for special attachment for the piping. In this case, however, the position of the piping is invariably at the center of the panel corresponding to the top of the truncated pyramid, so that the effective water level of the tank is unavoidably limited to a small value.

Moreover, sealing materials are generally positioned between the flanges of the panels for the purpose of preventing leakage at the connections. Dimensional errors of the assembled tank resulting from the sealing material which is generally deformable, may often cause extra cost in setting the tank in place.

Furthermore, when the assembled tank is used for holding a water supply, there is a danger of damage to the tank by the dynamic water pressure resulting from the oscillation of water caused by an earthquake.

SUMMARY OF THE INVENTION

It is therefore an object of the invention to provide an improved panel assembled tank which overcomes the above disadvantages in the prior art.

It is another object of the invention to provide a high pressure resistant assembled tank comprising bottom wall panels capable of rigidly setting columns with ease in the large tank and side wall panels having a high pressure resistance without increase of material.

It is further object of the invention to provide a highly hermetically sealed panel assembled tank by improving sealing connections between side and bottom wall panels and between the bottom wall panels.

It is still more object of the invention to provide a panel assembled tank incorporating particular panels for pipings to provide a sufficiently large effective water level without using special attachments when connecting pumping, supplying and draining pipes to the tank.

It is an object of the invention to provide an improved panel assembled tank having good drainage resulting from using particular bottom wall panels provided with a scupper.

It is another object of the invention to provide a high pressure resistant panel assembled tank whose side walls do not bulge even when being filled with water.

It is further object of the invention to provide a mounting structure for a panel assembled tank, on which the tank is fixed by means of bolts and nuts with ease irrespective of dimensional errors in the tank.

It is another object of the invention to provide an improved panel assembled tank capable of withstanding damage or failure caused by vibration resonance due to an earthquake.

The present invention provides a panel assembled tank comprising unit panels connected together, each unit panel formed with a pyramidal protrusion portion in the form of a pyramid or truncated pyramid progressively increasing in height toward its center which comprises a square wall surface of the panel and with securing flanges formed by folding peripheral edges of the panel, said panel comprising flat radial extension plates connecting adjacent surfaces of the pyramidal walls between the edges of the pyramid. Said tanks consist of (a) bottom wall panels, each of whose securing flanges are folded in a direction opposite to the extending direction of said protrusion portion of the bottom wall panel, and (b) side wall panels, each of whose securing flanges are folded in the same direction as that of the protrusion portion of the side wall panel, said side wall panels being formed along bottoms of said flanges with flat portions, and said securing flanges of said bottom and side wall panels facing outwardly and being clamped together to form the tank.

The present invention further provides a high pressure resistant panel assembled tank wherein said securing flanges and flat portions at the bottoms thereof of said side wall panels are thicker than the walls constituting said pyramids of the panels.

The present invention provides a highly hermetically sealed panel assembled tank comprising unvulcanized rubber sheets interposed between said securing flanges of said tank panels to improve the sealing of the tank.

The present invention further provides a panel assembled tank incorporating a square side wall panel for piping and a bottom wall panel for drainage.

The present invention provides a high pressure resistant panel assembled tank having tie rods and brackets for reinforcing the side walls.

The present invention further provides a base frame for a panel assembled tank and a mounting structure for mounting the tank on the base frame.

The present invention provides a panel assembled tank incorporating partitions therein depending from the upper end thereof.

The invention will be more fully understood by referring to the following detailed specification and claims taken in connection with the appended drawings.

DETAILED DESCRIPTION OF THE PREFERRED EMBODIMENTS

Figure 1:
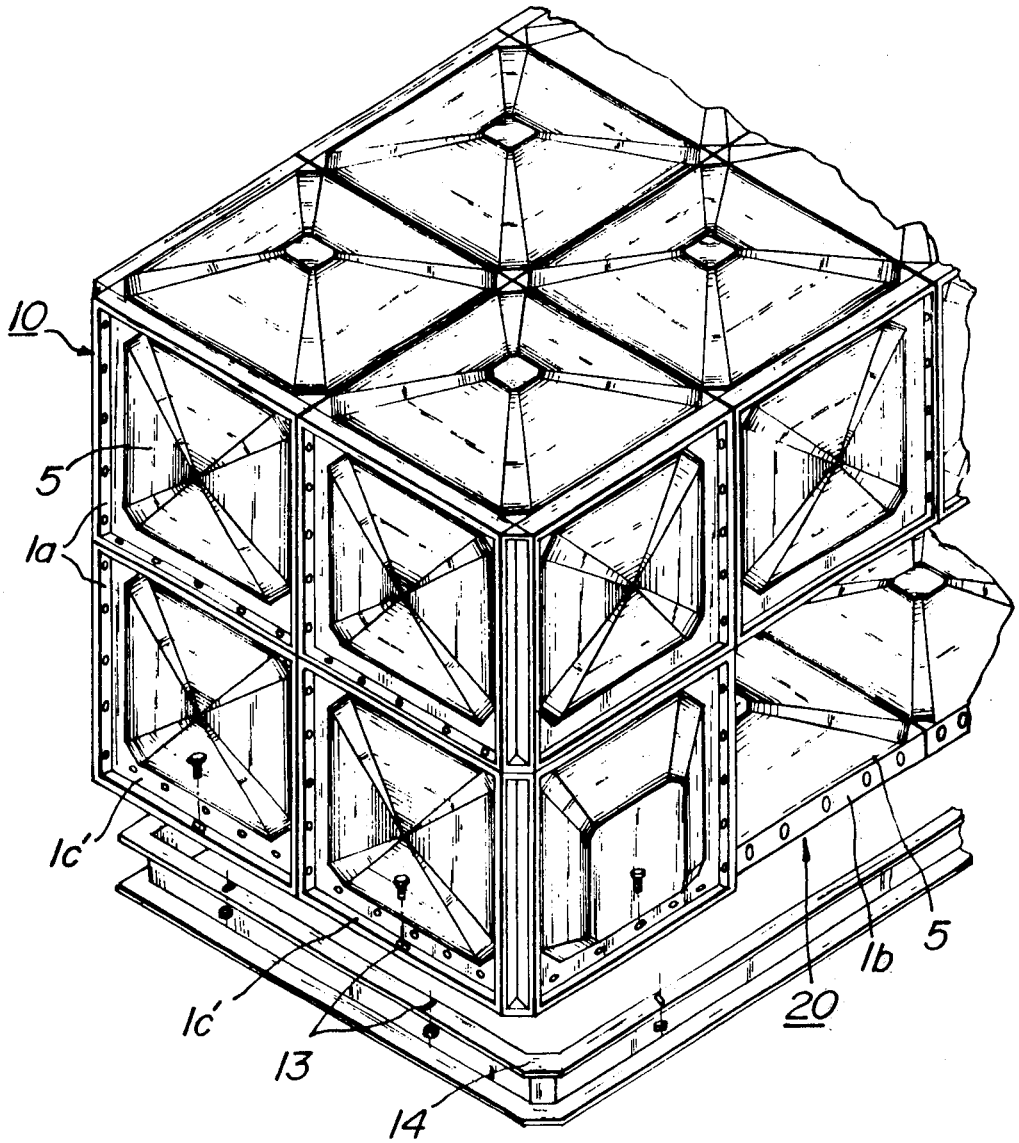
FIG. 1 is a perspective view of one embodiment of the high pressure resistant panel assembled tank, with few panels removed, according to the invention.
Figure 3:
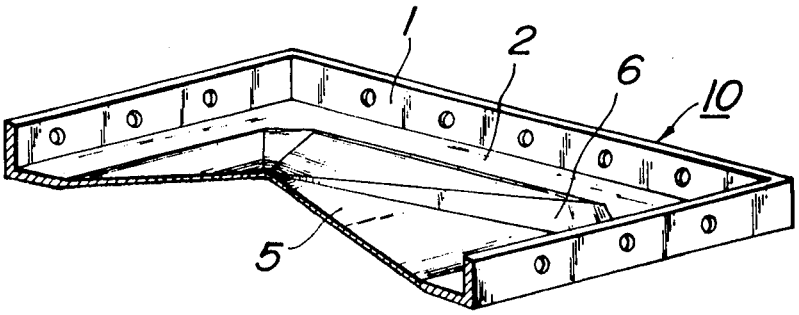
FIG. 3 is a sectional perspective view of a side wall panel of pyramidal form for use in the tank according to the invention.

Referring to the drawings showing the preferred embodiments of the invention, a high pressure resistant panel assembled tank having an outline as shown in FIG. 1 comprises side wall panels 10 and bottom wall panels 20. The side wall panel 10 is shown in detail in FIG. 3, wherein it consists of flanges 1, flat portions 2 and a pyramidal protrusion portion 5. The flanges 1 and flat portions 2 are thicker than the protrusion portion 5. The protrusion portion 5 is in the form of a pyramid and comprises extension plates or corner sector portions 6 radially arranged at the four corners and connecting the adjacent portions of the pyramid and which form the edges of the pyramid. These extension plates are uniform in thickness. A side wall panel 10 shown in FIG. 4 is substantially the same as that of FIG. 3 with the exception of the protursion portion which takes the form of a truncated pyramid.

Figure 2:
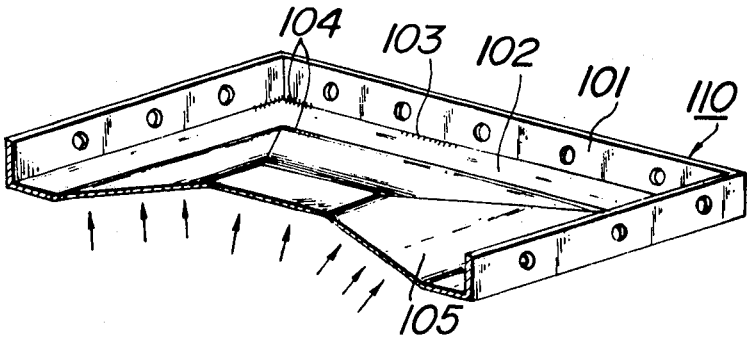
FIG 2 PRIOR ART
FIG. 2 is a sectional perspective view of a side wall panel of a panel formed tank of the prior art.

FIG. 2 shows a panel 110 for an assembled tank of the prior art which is uniform in thickness in flanges 101, flat portions 102 and a protrusion 105 in the form of a pyramid having no extension plates.

Figure 4:
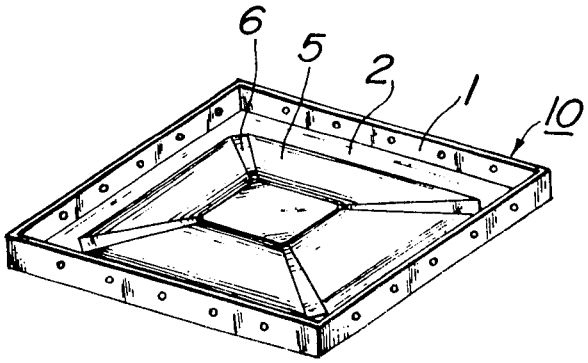
FIG. 4 is a perspective view of a side wall panel of truncated pyramidal form for use in the tank according to the invention.

A test was carried out for the purpose of comparison of the panel according to the invention as shown in FIG. 4 with the panels A, B and C of the prior art as shown in FIG. 2. These panels are square having 100 centimeter sides and made of a plastic material as orthophthalic resin reinforced by glass mat 450. The panels B and C have thicker flanges which are shown by increased plies in Table 1 which shows the results of the test.

Table 1

| | Panels according to the present invention | Panels in the prior art | | | | |
|---|---|---|---|---|---|---|
| | | (A) Uniform thickness | (B) Thickened flanges | (B) Flat portions | (C) Thickened flanges | (C) Flat portions |
| Flange and flat portion | Glass matt 450 # 10 plies | Glass matt 450# 5 plies | Glass matt 450# 7 plies | 4 plies | Glass matt 450# 10 plies | 2 plies |
| Pyramidal portions | Glass matt 450# 2 plies | Glass matt 450# 5 plies | Glass matt 450# 4 plies | | Glass matt 450# 2 plies | |
| Weight | 10.5 Kg | 11 Kg | 13 Kg | | 10.5 Kg | |
| Breaking pressure | 2.4 Kg/cm² | 0.5 Kg/cm² | 1.0 Kg/cm² | | 1.3 Kg/cm² | |

As can be seen the data in Table 1, the panel according to the invention is superior in pressure resistance to those in the prior art. In case of the panels (A) and (B) the breaks occur in the proximity of an area shown at 103 in FIG. 2 and in the panel (C) in the proximity of an area shown at 104. In contrast herewith, the panel according to the invention avoids such local breaks, although chalking all over the pyramidal portion when it is subjected to a load much higher than those in the panels (A), (B) and (C), and the break occurs all over the surfaces without local failures at lower loads as in the prior art.

It should be noted from the above fact that the panel according to the invention ensures the uniform distribution of stresses acting thereupon to improve the pressure resistance of a tank effectively without increasing required amount of material.

The bottom wall panel 20 comprises a protrusion portion 5 progressively increasing its height in the form of a truncated pyramid, and includes peripheral edges which are bent in a direction opposite to the protrusion portion 5 to form flanges 1. These flanges 1 of the bottom wall panels 20 are connected to each other to form a bottom wall of an assembled tank.

With the above bottom wall panels forming the bottom wall of the tank, since the square wall surfaces 8 extend inwardly like arches in the direction opposite to the extending direction of the flanges 1, there is a tendency for the bottom wall panels to be flattened when they are subjected to the pressure of liquid in the tank, so that the panels are forced toward each other at the contact surfaces of the flanges 1 to increase the contact pressure therebetween, that is, to tighten the panels together. Accordingly, the pressure in the tank tends to bring the panels into close contact with each other at the flanges in an air and water tight manner without adversely affecting the drainage at the bottom of the tank. These effects will be explained in more detail later.

Figure 8:
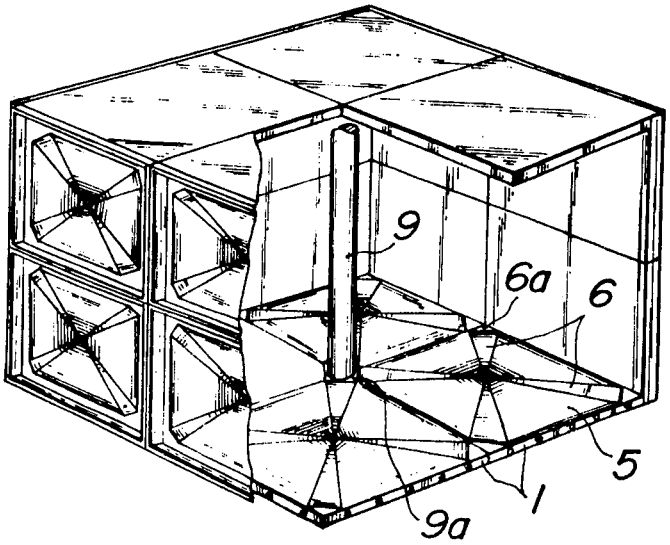
FIG. 8 is a perspective view showing a main part of the assembled tank partially cut away at the side walls according to the invention.

With the bottom wAll panel according to the invention, the adjacent surfaces forming the edges of the pyramid or truncated pyramid are connected to each other by the extension plates or corner section portions 6 to form at the four corners of the panel flat surface portions 7 surrounded by the bottom sides 6*a* of the extension plates 6 and peripheral sides 1*a* of the square wall surface 8. The flat surfaces 7 provide a flat surface 9*a* for mounting a column 9 having an area large enough to support it upstanding in the assembled tank at the center of four bottom wall panels when they are connected together in position to each other (FIG. 8).

The flat surface 9*a* is surrounded by the raising extension plates or corner sector portions 6 and protrusion portions 5 to provide a snugly supporting surface for the column 9 preventing it from being shifted without requiring any securing members for fixing the column 9 on the flat surface 9*a*. What is required is to cut the bottom ends of the column 9 at right angles to its axial direction.

Figure 5:
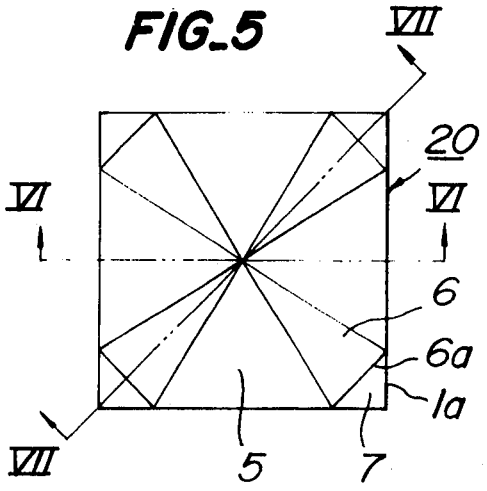
FIG. 5 is a plan view of a bottom wall panel to be used in the tank according to the invention.
Figure 6:
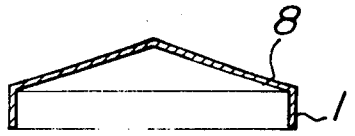
FIG. 6 is a sectional view of the bottom wall panel taken along the line VI—VI of FIG. 5.
Figure 7:
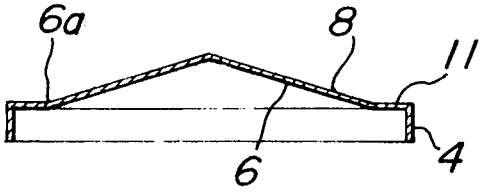
FIG. 7 is a sectional view of the bottom wall panel taken along the line VII—VII of FIG. 5.

It is preferable to form each flat surface 9*a* for the column 9 having slightly larger sides than the outer diameter of the column. It is also preferable to make the flat surfaces 7 of right-angled isosceles triangle form as shown in FIG. 5, to form a square flat surface 9*a* when the four bottom wall panels are connected together. The flat surfaces 7 may be of other configuration according to the section of the column 9.

As can be seen from the above description, the bottom wall panel according to the invention having the protrusion portion 5 and the flanges extending in the opposite direction to that of the protrusion portion provides a self hermetic seal between the flanges of the adjacent panels resulting from the pressure in the tank to keep a high air or watertight seal at the bottom thereof without adversely affecting the drainage. Furthermore, the bottom wall panel according to the invention makes it possible to set the column stably on the bottom of the tank by the use of flat surfaces surrounded by the bottom sides of the extension plates 6 and peripheral sides 1*a* of the overall square wall surface 8.

Figure 9:
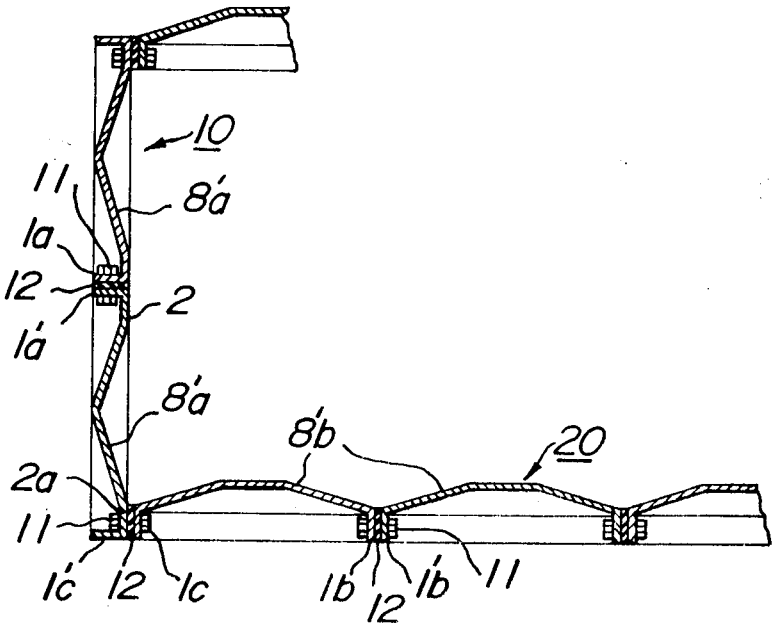
FIG. 9 is a partial sectional view of the panel assembled tank having unvulcanized rubber sheets embraced between the side wall panels.

FIG. 9 illustrates a partial section of the assembly of the side wall panels 10 and bottom wall panels 20. The side wall panels 10 have their securing flanges 1 all extending outwardly around the pressure supporting square surfaces 8'*a* for connecting together the adjacent panels to form side wall panels for the tank. The bottom wall panels 20 have also the securing flanges 1 all extending outwardly around the pressure supporting square surfaces 8'*b* for connecting together the adjacent panels to form a bottom wall panel for the tank. The connection of the side and bottom wall panels is effected by securing the flanges 1 of the bottom wall panels 20 to the flat portions 2*a* at the bottoms of the flanges of the side wall panels as shown in FIG. 9.

In order to more improve the hermetic seal of the assembled tank, unvulcanized rubber sheets 12 are arranged between the securing flanges 1*a* of the side wall unit panels 10, between the securing flanges 1*b* of the bottom wall unit panels 20 and between the securing flanges 1*c* of the assembled bottom wall panels 20 and the flat portions 2*a* at the bottoms of the securing flanges of the assembled side wall unit panels 10, and then these flanges and flat portions are tightened by means of bolts 11.

The unvulcanized rubber sheets used herein generally exhibit the visco-elasticity to accommodate variation in distance between the securing flanges 1*a*, 1'*a* and 1*b*, 1'*b* and the securing flanges 1*c* and the flat surfaces 1*a*. Particularly, when a cross-shaped connection is formed by the four connected panels, the unvulcanized rubber sheet flows into the central portion of the cross-shaped connection to completely seal the connection in a complete air and watertight manner.

The unvulcanized rubber is generally adhesive at its surfaces which serves to prevent the rubber sheets 12 from being shifted or falling off to facilitate the assembling of the panels. Moreover, the unvulcanized rubber sheet can easily be drilled for receiving the clamping bolts and to keep the high fluid tight seal at the bolted portions of the tank.

The unvulcanized rubber sheet is preferably one superior in weather and water proof properties such as butyl rubber. However, any kind of the unvulcanized rubber may be used for this purpose unless it has the inherent property of the unvulcanized rubber and contaminates liquid as water and the like accommodated in the assembled tank.

When pumping pipes, water supply pipes, over-flow pipes, etc. are arranged on the assembled tank, it is more convenient to combine the tank with special panels for mounting pipings to be explained hereinafter. As shown in the plan view in FIG. 10, the square panel 10*a* or 10*b* for mounting pipings is formed except for the flat portion 2 the wall surfaces 8*a* take the form of a truncated pyramid extending in the same direction as the flanges 1. The truncated pyramid 8*a* comprises four oblique surfaces 5*a*–5*d* and at their inner ends, piping securing surface 15, which is parallel to the flat surface 2 and jointed at the top of the pyramid to the oblique surfaces 5a–5d. Surfaces 5a–5d are joined at their edges by interposed corner sector portions or extension surfaces 6a–6d.

Figure 10:
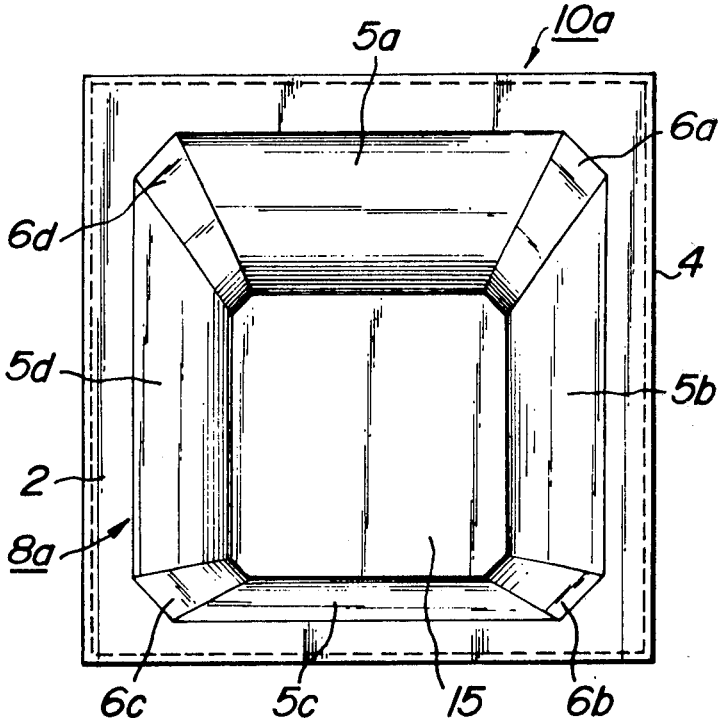
FIG. 10 is a plan view of a square panel for securing piping according to the invention.

The lengths of the sides of the oblique surface 5a and the extension surfaces 6a, 6d connected to each other are larger than those of the sides of the oblique surface 5c and the extension surfaces 6c, 6d to make the piping securing surface 15 eccentric to the center of the square panel 10a or 10b as shown in FIG. 10.

Figure 11:
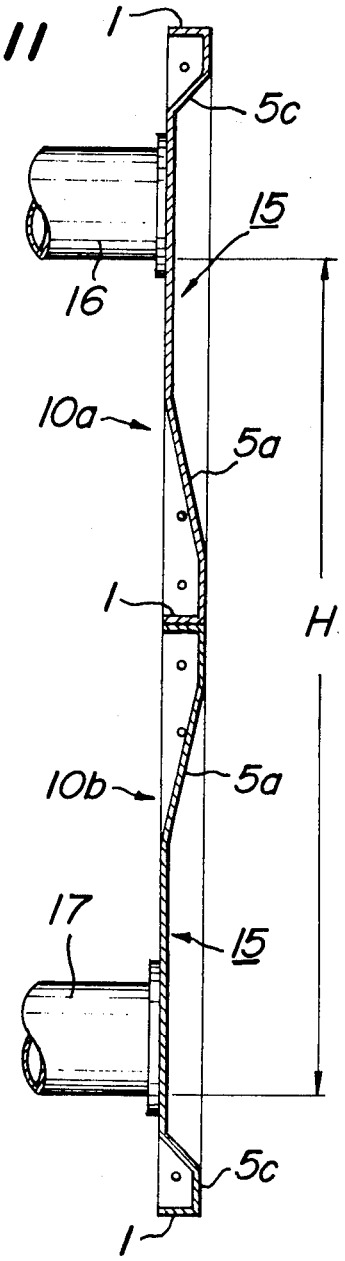
FIG. 11 is a sectional view of a panel assembled tank using square panels for securing pipings according to the invention.

In assembling the square panels 10 having the pyramids or truncated pyramids and the panels 10a and 10b having the eccentric truncated pyramids, the square panel 10a is arranged at the upper portion of the side surface of the assembled tank in the position where the shorter oblique surface 5c is located above the longer oblique surface 5a and the square panel 10b is arranged at the lower portion of the side surface of the assembled tank in the position where the shorter oblique surface 5c is located below the longer oblique surface 5a as shown in FIG. 11 and these square panels 10a and 10b are connected at their flanges 1 to each other. Then the over-flow pipe 16 and water supply pipe 17 are connected to the piping securing surfaces 15 of the upper and lower square panels 10a and 10b, respectively. In this case, as shown in FIG. 11 a flood pipe 16 is arranged as high as possible relative to the associated piping securing surface 15 and a supply pipe 17 is arranged as low as possible relative to the associated piping securing surface 15 to provide a largest possible effective water level (as shown in H in FIG. 11) when the tank is used as a water tank.

As can be seen from the above description, the high pressure resistant assembled tank using the square panels having the piping securing surfaces of the truncated pyramids eccentric to the center thereof according to the invention does not require any particular attachment for connecting the pumping pipes and water supply and over-flow pipes, and can obtain a high effective water level of the tank.

Figure 12:
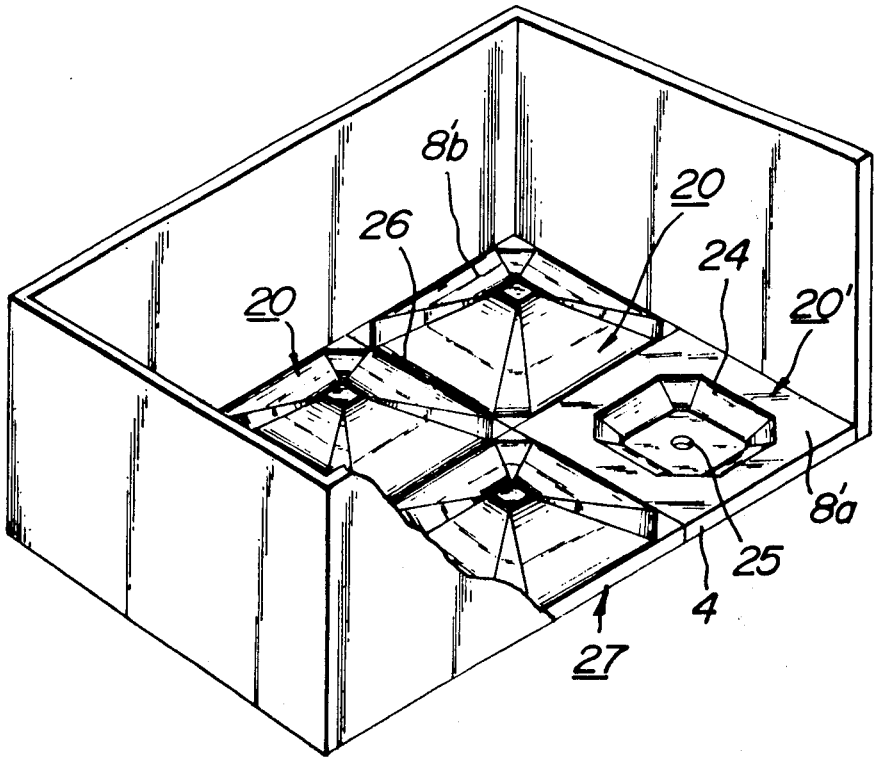
FIG. 12 is a perspective view showing a main part of the assembled tank using a bottom wall panel having a scupper according to the invention.

As shown in FIG. 12, at least one unit panel 20' of the bottom wall unit panels has formed at the center of the pressure receiving square surface 8'a, a recess 24 which is preferably in the form of a truncated pyramid as shown in FIG. 12 and is further provided at its bottom with a scupper or hole 25 to which is of course fitted a drain plug (not shown).

The unit panels 20, other than the panel 20' having the drainage, have protrusion portions 5 progressively increasing in their height toward the centers of the respective unit panels to form drain paths 26 between the unit panels. As shown in FIG. 12, these drain paths are communicated with each other in the form of a lattice in a substantially horizontal plane and with the recess 24 of the panel 20', so that when the scupper 25 is opened, the water in the tank is completely drained.

Figure 13:
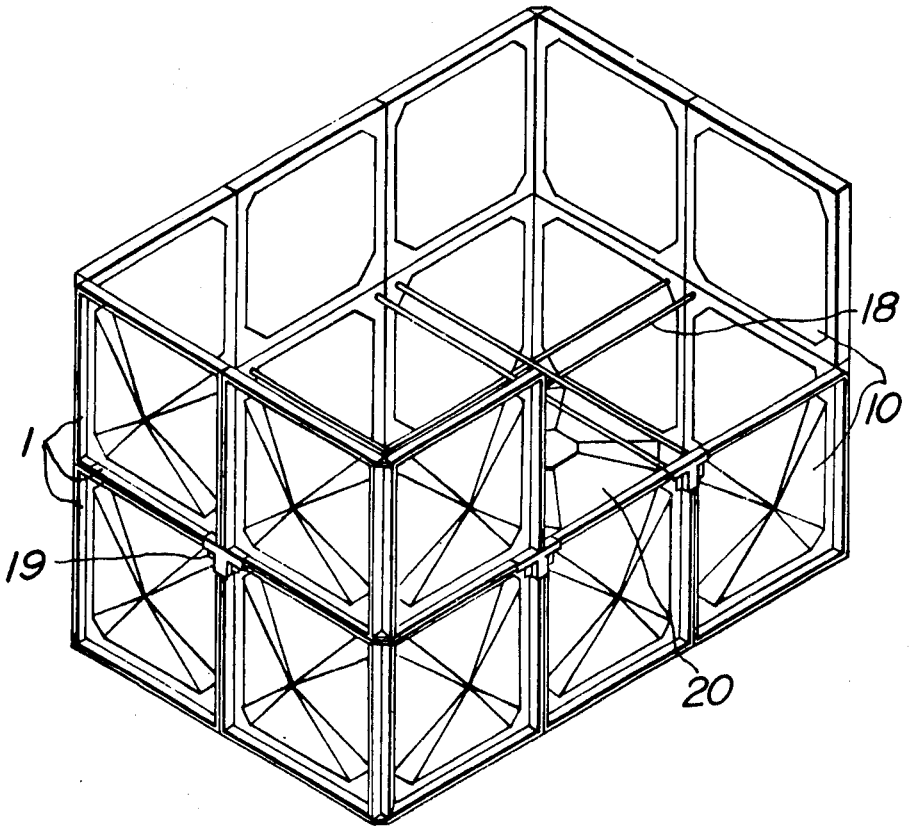
FIG. 13 is a perspective view of a panel assembled tank, partially cut away, incorporating tie rods according to the invention.
Figure 14:
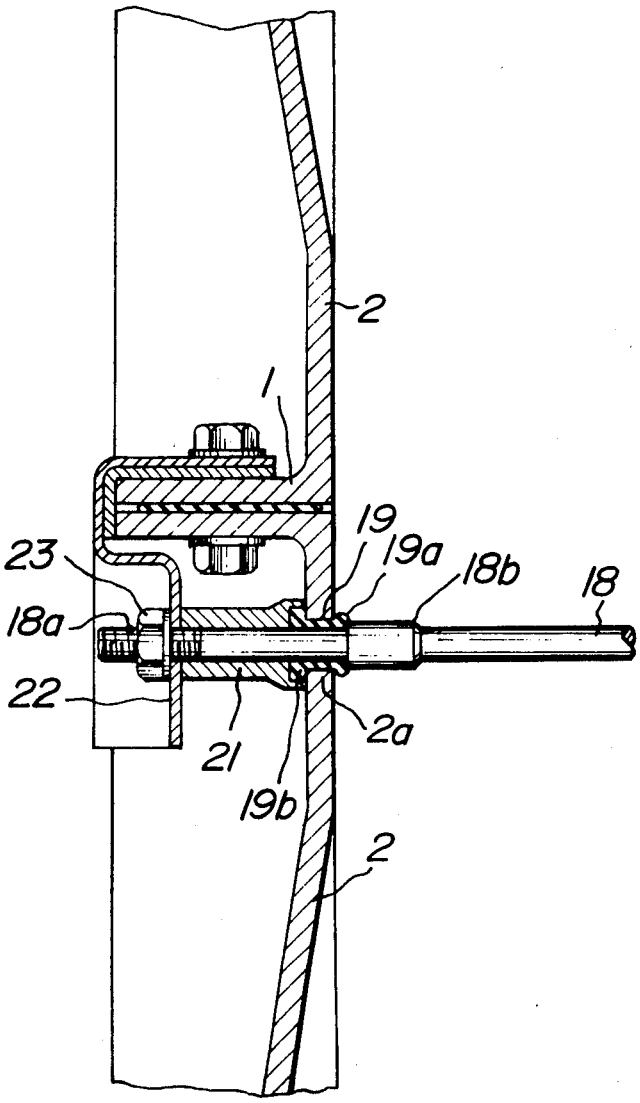
FIG. 14 is an enlarged sectional view of the unit panels showing the connections of the tie rods to the panels.
Figure 15:
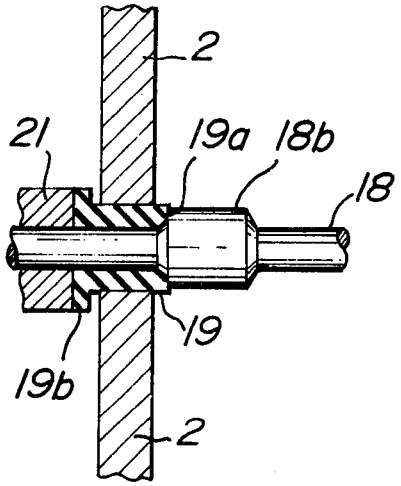
FIG. 15 is a partial sectional view of the connection of a panel to the end of the tie rod before being clamped.

A large assembled tank as one embodiment of the invention is illustrated in FIG. 13 wherein side wall unit panels 10 are reinforced by tie rods 18 connecting them to withstand the increased inner pressure of the tank. Each tie rod 18 is formed its ends with threaded portions 18a and with larger diameter portions 18b as stoppers spaced from the threaded portions 18a as shown in FIGS. 14 and 15. The threaded portion 18a of the tie rod 18 passes from the inside of the tank through a connecting hole 2a formed in the flat surface 2 of a unit panel 10 and a flanged cylindrical rubber bushing 19 longer than the thickness of the unit panel 10 is fitted in the hole 2a and onto the rod 18. A spacer 21 is provided about a part of the threaded portion on the rubber bushing 19 and a bracket 22 is further arranged on the bushing and clamped thereon by a nut 23 threadedly engaged with the threaded portion 18a of the tie rod 18. The bracket is bolted to flanges 1 of abutting unit panels 10.

FIG. 15 illustrates the condition of the tie rod before tightening the nut 23, wherein the larger diameter portion 18b must be inside of the inner surface of the flat surface 2 of the unit panel and the length of the flanged rubber bushing 19 except the flange must be longer than the thickness of the flat surface 2 of the unit panel. If the larger diameter portion 18b of the tie rod 18 is considerably spaced from the inner surface of the tank, the watertight seal at the hole 2a of the panel after clamping will be lost even if the length of the flanged rubber bush 19 is sufficiently longer than the thickness of the panel. Accordingly, the tie rod 18 should be so designed that the larger diameter portions are as near as possible to the inner surfaces of the tank. The outer diameter of the flange 19b of the rubber bushing 19 should be larger than the inner diameter of the hole 2a of the flat surface of the square panel.

The tie rod is preferably made of a rigid material such as a steel rod. The tie rod consists preferably of two or three element rods which are axially connected to form a tie rod having at its ends the threaded portions 18a and the larger diameter portions 18b. Such a prefabricated tie rod makes it very easy to effect the assembly of the tank and makes it possible to adjust the overall length of the tie rod to position the larger diameter portions 18b of the rod at the optimum positions to improve the watertight seal as described later.

Starting from the position of the tie rod 18 as shown in FIG. 15, when the nut 23 out of the tank is threadedly tightened progressively on the threaded portion 18a of the rod 18, the inner end 19a of the rubber bushing 19 expands at the larger diameter portion 18b of the rod 18 and the flange 19b of the bushing 19 is brought into contact with the outer surface of the flat surface 2 of the square panel. Accordingly, the unit panel 10 is not inwardly forced to an undue extent so that the unit panels 10 can be fixedly clamped without being subjected to over stresses. When the assembled tank is filled with water, the water pressure acts on the unit panels 10 so as to force them outwardly. In this case, however, the flange 19b of the rubber bushing 19 keeps the watertight seal at the outer surface of the flat surface 2 of the panel and the tie rods 18 prevent the side walls from being bulged.

Figure 16:
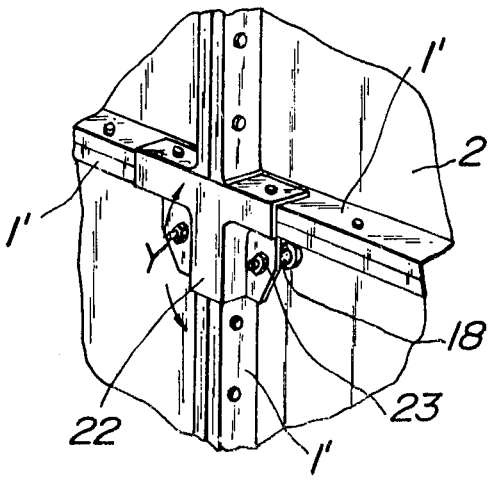
FIG. 16 is a perspective view of the connection of a bracket at the corners of the unit panels according to the invention.

FIG. 16 is a perspective view on an exaggerated scale of the ends of the tie rods wherein the T-shaped bracket 22 is fixed to the securing flanges 1' forming a cross connection at the corners of the four unit panels. The tie rods 18 pass through the bracket 22 so that the load from the water pressure in the tank distributed on the three pairs of securing flanges 1 forming a T-shaped connection is supported by the bracket 22 to be transmitted to the tie rods 18 without unduly loading the panels. The bracket may be in the form of a cross shape embracing all the four pairs of the securing flanges 1. In this case, the load from the water pressure in the tank acting upon the four pairs of the securing flanges is supported by the tire rods.

As can be seen from the above detailed explanation, the panel assembled tank reinforced by the tie rods according to the invention does not bulge by the water pressure even if it is full of water. Accordingly, the assembled tank according to the invention is particularly preferable in large assembled tank consisting of a number of the unit panels connected to each other. The water pressure in the tank acting upon the side walls is distributed through the tie rods to the respective side wall unit panels, so that the pressure resistance of the assembled tank as a whole is substantially equal to the respective pressure resistance of the unit panels which is very preferable in quality control of the assembled tanks. Moreover, the flanged rubber bushings are interposed between the tie rods and the unit panels and the inner ends of the bushings are expanded by the larger diameter portions of the tie rods, so that the watertight seal at the connection of the tie rods to the panels can be remarkably improved.

The thus assembled tanks have the unvulcanized rubber sheets 12 interposed between the securing flanges 1*a* and 1′*a* and 1*b* and 1′*b* and securing flanges 1*c* and the flat surfaces 2*a*. Accordingly, dimensional errors in manufacturing the tanks are unavoidable. To avoid difficulties resulting from the dimensional errors, apertures 13 for bolts formed in the securing flanges 1′*c* of the side wall unit panels and base frame 14 for securing to each other are made as elongated apertures of which longer axes are perpendicular to each other when the tank is arranged on the base frame 14 are set on the roof of a building as shown in FIG. 1. In this manner, the panel assembled tank can easily be fixed onto the base frame by means of bolts and nuts irrespective of the dimensional errors in manufacturing the tank and frame. It should be noted that the fixing method described herein is not limited to the tank using the unvulcanized rubber sheets interposed between the unit panels.

When the large assembled tank is used to be filled with water, long periods such as 2–10 seconds of vibration components included in vibrations from an earthquake may coincide with the primary period of natural vibration of water in the tank, causing resonance of the vibrations resulting in damage to the tank.

In general, the primary period ($T$ seconds) of natural vibration of water in the tank is obtained by the following empirical formula where $D$ centimeters is the length of the tank in the vibrational direction.

$$T = 0.11\sqrt{D}$$

When $D$ is 400 centimeters, $T$ is 2 seconds. Accordingly, there is a high possibility of a tank having a length more than 4 meters will cause resonance with vibration components having long periods from an earthquake.

Figure 17:
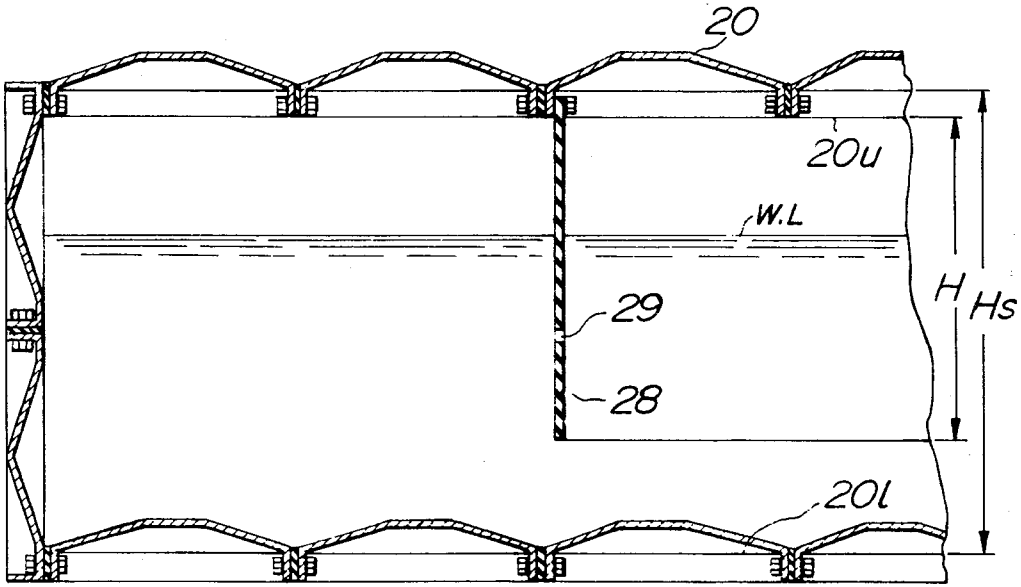
FIG. 17 is a sectional elevation of a part of a panel assembled tank incorporating partitions according to the invention.

FIG. 17 illustrates one embodiment of the tank according to the invention particularly designed in order to solve the problem of resonance, wherein flexible partitions 28 are arranged within the tank at suitable intervals such as 2–4 meters and depending from the upper portion 20$\mu$ of the tank to somewhat above the bottom plates. The partition is preferably made of a flexible material such as rubber or plastic or a composite material consisting of a flexible portion to be fixed to the tank and a remaining portion made of a rigid material. The height H of the depending partitions should be more than one half of the distance H*s* between the upper and bottom portions of the tank because if the water in the tank is not more than one half of the volume of the tank, the load caused by the movement of the water will become smaller and there is no trouble resulting from the resonance of vibrations. The partition does not require watertight sealing and may be formed at its lower portion with through apertures 29. The partitions are fixed to the upper closure as in the embodiment shown in FIG. 17. However they may be fixed to the side or bottom walls. The partitions are not necessarily arranged at equal intervals and may be arranged at suitable intervals such as 2–4 meters, at will. With such an arrangement, the partitions, that is, wave damping plates can bring about an effect as if the length D of the tank were 2–4 meters which is an important factor of a natural period of water. Accordingly, however large the tank may be, the natural period of the tank can be restrained to less than 2 seconds which is different from the long periods 2–10 seconds of the earthquake vibration sufficient to avoid the resonance and prevent the side wall of the tank from being damaged.

The through apertures 29 formed in the lower portions of the partitions serve to damp the oscillation of water quickly because the resistance of the water at the apertures occurs when flowing through them. Furthermore, the flexibility of the partitions makes it easy to fix them to the wall of the tank and makes the moment at the connections between the partition and the unit panels smaller to avoid torsional forces acting upon the tank. In a more preferable embodiment of the invention the partitions are arranged at random so that the natural periods of water in sections defined by the partitions are different from each other with the result that the loads acting upon the partitions are cancelled by the damping effect resulting from the interference of the shifted phases of the waves. The arrangement of the partitions makes it possible to change the directions of the waves to more improve the effectiveness of the partitions arranged in the tank. In consideration of horizontal vibrations in all directions, the partitions are required to have at least two directions.

It is understood by those skilled in the art that the foregoing description is preferred embodiments of the disclosed tank and that various changes and modifications may be made in the invention without departing from the spirit and scope thereof.

What is claimed is:

1. A panel assembled tank comprising square wall surface unit panels connected together, each unit panel formed with a pyramidal protrusion portion progressively increasing in height toward the panel center and having integral folded securing flanges at the peripheral edges thereof, said protrusion portion including corner section portions radially arranged at the unit panel corners and forming therebetween edges of the pyramidal protrusion portion, said wall surface unit panels comprising bottom wall panels, at least some of said bottom panels having securing flanges folded in a direction opposite to the extending direction of said protrusion portion thereof, said panels further comprising side wall panels, each side wall panel having securing flanges folded in the same direction as the protrusion portion of the side wall panel, said side wall panels being formed peripherally along the bottoms of said flanges with flat portions, and means for securing the flanges of said bottom and side wall panels together and facing outwardly to form said tank.

2. A panel assembled tank as set forth in claim 1, wherein said securing flanges and flat portions at the bottoms thereof of said side wall panels are thicker than said pyramidal protrusions.

3. A panel assembled tank as set forth in claim 1, wherein said flange securing means comprises means for connecting all of said side wall panels together to form a side wall panel assembly and bottom wall panels together with their securing flanges to form a bottom wall panel assembly, and the flat portions at the bottoms of said securing flanges at the lower ends of said thus assembled side wall panel assembly and said securing flanges at peripheries of said thus assembled bottom wall panel assembly together to form said tank.

4. A panel assembled tank as set forth in claim 1, wherein unvulcanized rubber sheets are interposed between said securing flanges of said tank and said securing means comprising bolts for bolting the flanges together to connect said panels to form said tank.

5. A panel assembled tank as set forth in claim 1, wherein at least one of said side wall panels has a pyramidal protrusion portion in the form of a truncated pyramid of which top truncated surface is parallel with said flat portions of the panel and is eccentric to the center of the panel to form a piping securing surface.

6. A panel assembled tank as set forth in claim 1, wherein at least one of said bottom wall panels has its pyramidal protrusion portion in the form of a truncated pyramid of which truncated surface is provided with a scupper and said securing flanges are folded in a direction the same as that of the protrusion portion of the bottom wall panel.

7. A panel assembled tank as set forth in claim 1, wherein said tank further comprises tie rods formed at their ends with threaded portions and larger diameter portions spaced from the ends, portions between the threaded portions and the larger diameter portions of said tie rods passing through connecting holes formed in the opposite side wall unit panels, and flanged cylindrical rubber bushings longer than a thickness of the unit panels being fitted about said tie rods and said connecting holes of the side walls, and said tie rods being tightened by means of nuts to reinforce the side wall of the tank.

8. A panel assembled tank as set forth in claim 7, wherein said tank further comprises brackets fixed to said securing flanges at respective corners of the four side wall panels of opposite side walls of the tank and covering at least three pairs of securing flanges of the cross section, and said tie rods having at their ends threaded portions extending between said opposite side wall panels and threadedly clamped through spacers between said opposite brackets.

9. A panel assembled tank as set forth in claim 1, wherein there is provided a base frame for setting said tank thereon, and the securing flanges extending from the peripheries of said bottom side wall panels and portions of said base frame confronting the securing flanges are formed with elongated apertures of which longer axes are perpendicular to each other to facilitate the mounting said tank on the base frame.

10. A panel assembled tank as set forth in claim 1, wherein flexible partitions are arranged within said tank at intervals such as 2–4 meters and depending from the upper end of the tank to somewhat above the bottom wall of the tank.

* * * * *